United States Patent [19]

Van Mullekom

[11] 4,372,498

[45] Feb. 8, 1983

[54] DEVICE FOR FORMING STORE UNITS FROM A THREAD SUPPLIED FROM A YARN PACKET

[75] Inventor: Hubert P. Van Mullekom, Deurne, Netherlands

[73] Assignee: Ruti-Te Strake B.V., Deurne, Netherlands

[21] Appl. No.: 199,579

[22] Filed: Oct. 22, 1980

[30] Foreign Application Priority Data

Nov. 27, 1979 [NL] Netherlands ..... 7908595

[51] Int. Cl.[3] ..... B65H 51/20

[52] U.S. Cl. ..... 242/47.01; 139/452; 242/47.12

[58] Field of Search ..... 242/47.01, 47.02, 47.03, 242/47.04, 47.05, 47.06, 47.07, 47.08, 47.09, 47.1, 47.11, 47.12, 47.13, 82, 83, 47; 139/452; 66/132 R

[56] References Cited

U.S. PATENT DOCUMENTS

| | | | |
|---|---|---|---|
| 3,411,548 | 11/1968 | Pfarrwaller | 242/47.12 X |
| 3,674,057 | 7/1972 | Hosono et al. | 139/452 |
| 4,132,370 | 1/1979 | Van Mullekom | 242/47.12 |
| 4,238,080 | 12/1980 | Van Mullekom | 242/47.12 |

*Primary Examiner*—Stanley N. Gilreath

*Attorney, Agent, or Firm*—C. O. Marshall, Jr.

[57] ABSTRACT

A device for forming store units from a thread supplied from a yarn packet. The store units are formed on a winding drum between limiting pins which may assume an operative and an inoperative position. A brake means, e.g. brake shoe, is applied to the last part of a thread winding being released from the drum in order to avoid pulls and thereby tension peaks on the thread which otherwise might cause thread failure.

3 Claims, 4 Drawing Figures

DEVICE FOR FORMING STORE UNITS FROM A THREAD SUPPLIED FROM A YARN PACKET

BACKGROUND OF THE INVENTION

The invention relates to a device for forming store units from a thread supplied from a yarn packet, in which the store units are successively laid onto a carrying surface and there temporarily are enclosed between a back and a front limiting means, as seen in the supply direction, said limiting means being adapted to assume alternately with a phase shift an operative and an inoperative position, such that each time when the front limiting means assumes the inoperative position, the front store unit is released for being drawn from the carrying surface, and the next store unit assumes the position of the released store unit.

Such a device is e.g. known from U.S. Pat. No. 4,132,370. In this known device which is designed for intermittently feeding the weft transporting device of a shuttleless weaving machine, the carrying surface is part of a winding drum onto which the thread store units are laid through the intermediary of a rotating winding arm in the shape of thread windings. The limiting means are therein constituted by pins carrying out a translation movement in a plane containing the axis of the winding drum, such that said pins successively move outwardly from the space within the drum and at the release end of the drum are again retracted. As soon as the front limiting pin is retracted into the space within the drum the store winding which was up till that moment confined behind said pin is drawn by the weft transporting device of the weaving machine, while the store winding which is formed behind the next limiting pin is moved towards the drawing off end of the drum in order to be released during the next weft phase of the weaving machine for being drawn off.

A disadvantage in such a device is that the last part of a thread store winding, which has been released for being drawn off, is suddenly drawn taut at the end of the drawing off movement around the next limiting pin (which constitutes the front limiting pin for the next store unit) which causes a pull on the thread. Thereby tension peaks may be generated which may lead to thread failure.

The invention aims at removing this disadvantage.

SUMMARY OF THE INVENTION

According to the invention this aim is achieved in that over the carrying surface a brake means has been provided which in the last phase of the movement of the store unit which has been released for being drawn off, is adapted to assume an operative position relative to the carrying surface, in order to brake the drawing off movement during that phase.

Generally the last portion of a thread store unit will extend more or less transversally relative to the drawing off direction. By the measure according to the invention the deflection of the last thread portion at the end of the drawing off movement to the stretched condition in the supply direction takes place more gradually so that pulls on the stretching thread and thereby tension peaks are avoided.

In a preferably applied embodiment in which the carrying surface, as in the above mentioned known device, is part of a stationary winding drum cooperating with a rotary winding arm and the store units are laid onto the drum in the shape of windings, the brake means according to the invention is constituted by a brake shoe cooperating with the drum surface.

In a practical embodiment the brake shoe surface facing the drum surface is provided with bristle hairs.

DESCRIPTION OF THE PREFERRED EMBODIMENT

Figure 1:
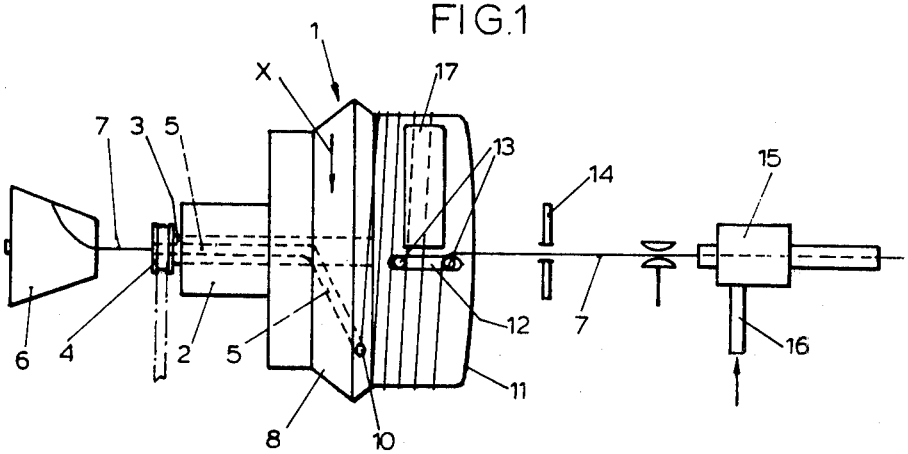
FIG. 1 shows a schematic plan view of the device according to the invention arranged between a yarn packet and a weft transporting device for a pneumatic weaving machine.

The device bearing the reference number 1 in the drawing has a sleeve shaped supporting part 2 with the intermediary of which the device may be secured to the frame of a yarn processing machine, particularly a shuttleless weaving machine. In this sleeve shaped supporting part 2 a shaft 3 is rotatably journalled and carries at its end projecting left in the drawing beyond the supporting part 2 a driving disc 4 which is drivable in a predetermined ratio to the main drive shaft of the yarn processing machine. The shaft 3 has an axial bore 5 for guiding the yarn 7 supplied from the yarn packet 6. Reference number 8 indicates a rotary part of the device which is secured to the shaft 3 and contains a yarn guide channel 5 which connects the central yarn guide bore 5 to an aperture 10 at the periphery of the rotary part 8. Reference number 11 indicates a stationary winding drum which remains stationary when the shaft 3 rotates.

The casing of the drum 11 has an axial slot 12 through which limiting pins 13 may project from the space within the drum outwardly and simultaneously may move in axial direction, to the right as shown in the drawing. Said pins form part of a mechanism which is not further shown in the drawing and is known per se, which is mounted inside the drum 11 and e.g. has the embodiment hereinbefore described as shown in U.S. Pat. No. 4,238,080.

Reference number 14 indicates a thread guide eye arranged in the axis of the drum 11 and serving for guiding the yarn, which is intermittently drawn off the drum 11, to the weft transporting means indicated at 15 which is fed with transport air e.g. at 16.

So far the device is of a structure which is known per se, at least described in earlier patent applications.

Figure 2:
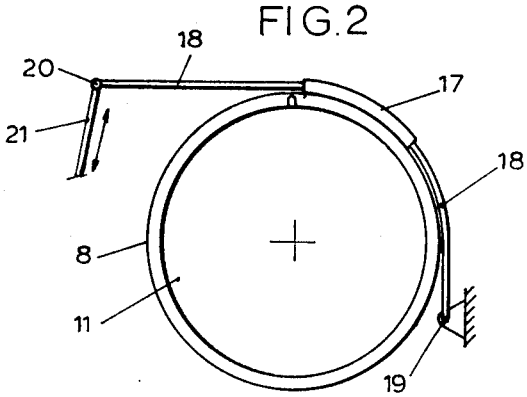
FIG. 2 shows an end view of the device according to the invention in which the brake means is in its operative position.

According to the invention the drum 11 cooperates with a brake means 17 constituted by a brake shoe arranged at the side of the slot 12 remote from the direction X of rotation of the rotary part 8 and secured to a lever 18, which is pivotable around a fixed point 19 between an inoperative and an operative position (see FIG. 2). The lever 18 carrying the brake shoe 17 is curved over the drum and is connected at its end 20 remote from the pivot point 19 to an actuating rod 21, the movement of which, indicated by the two-headed arrow, is derived in a manner not further shown from the main shaft of the yarn processing machine or weaving machine respectively. In the embodiment shown the operative surface of the brake shoe 17 facing the drum is provided with bristle hairs.

In FIG. 1 the device according to the invention is shown at a moment in which both limiting pins 13 are in their operative position and therefore project outwardly. The left pin 13 has just moved outwardly from the space within the drum through the slot 12, while the right pin 13 is about to move inwardly through the slot 12. In the position shown a predetermined number of yarn windings is present between both pins. This number of yarn windings constitutes a store unit. When applied to a weaving machine the number of yarn windings of this store unit is selected in correspondence with the weaving width. In practice this will be e.g. five windings but in the drawings for clarity's sake only three windings have been shown. The left pin therein constitutes a separation between said store unit and the windings which are laid onto the drum by the rotary part 8 left of this pin and which are to constitute the next store unit.

Figure 1A:
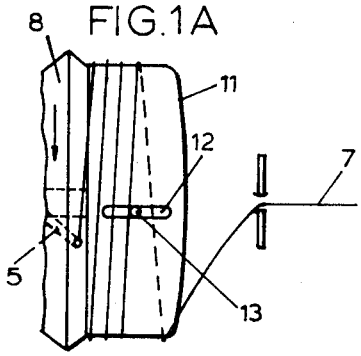
FIG. 1A shows the winding drum of the device according to the invention during a phase in which a yarn unit is drawn from the drum.
Figure 1B:
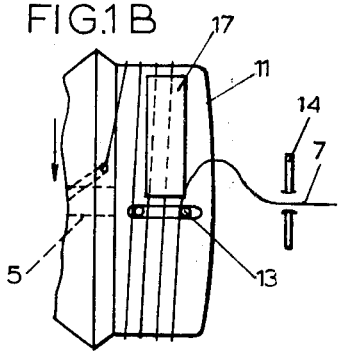
FIG. 1B is a plan view of the winding drum of the device according to the invention, in which it is indicated how the last portion of the drawing off movement occurs as influenced by the braking means.

FIG. 1A shows the device at a moment during which a store unit is drawn from the drum 11 under the influence of the pulling force imparted by the weft transporting device 15 to the store unit. In that moment the right limiting pin 13 according to FIG. 1 has a position retracted into the space within the drum 11, while the left limiting pin 13 according to FIG. 1 is still in its operative position and has been moved to the right. The store unit forming left of the pin 13 in FIG. 1A is almost complete, that is a next limiting pin is about to move outwardly at the left end of the slot 12. In the moment as shown in FIG. 1A only a portion of the last winding of the relative store winding is present on the drum 11. It is clear that this last winding portion would be drawn taut shortly afterwards with a pull around the limiting pin 13 and that thereby a tension peak in the yarn would occur. According to the invention such a tension peak is countered in that, at the moment of FIG. 1A in view, the brake shoe 17 is moved towards the drum surface. The result thereof is that the displacement in axial direction of the last winding portion to be drawn off takes place more gradually and that the stretching yarn of the relative store winding nestles more gradually around the limiting pin 13 as shown in FIG. 1B. It is clear that controlling the brake shoe must be done such that the brake shoe only becomes operative during the last part of the drawing off movement. In application to a weaving machine this means that the brake shoe is only operative during the last part of the weft phase of a weaving cycle, that is always in a rather accurately defined period.

I claim:

1. A device for forming store units from a thread supply, comprising, in combination, a stationary winding means defining a circumferential winding surface, a longitudinal slot in said surface, a thread guide rotatably mounted adjacent to one end of said surface for winding the thread on said surface, a plurality of pins which are movable in succession in an endless path in the radial plane of said slot, first radially outward to protrude through the portion of said slot adjacent to said one end of said surface, then forward along said slot, and then radially inward to retract into said slot, thereby separating the thread windings on said surface into successive store units, each store unit comprising a plurality of thread windings, and thread transporting means for drawing each store unit forward off said surface as it is released by retraction of a pin, wherein the improvement comprises brake means which is movable into braking contact with the trailing portion of each store unit of thread as withdrawal of such store unit from said surface is completed.

2. A device according to claim 1, in which the winding surface is part of a stationary winding drum cooperating with a rotary winding thread guide, and the store units are laid onto the drum in the shape of windings, characterized in that the brake means is in the shape of a brake shoe cooperating with the drum surface.

3. A device according to claim 2, characterized in that the brake shoe surface facing the drum surface is provided with bristle hairs.

* * * * *